US006094961A

United States Patent [19]

Aschberger

[11] Patent Number: 6,094,961

[45] Date of Patent: Aug. 1, 2000

[54] APPARATUS AND METHOD FOR NECKING CONTAINER ENDS

[75] Inventor: Anton A. Aschberger, Downers Grove, Ill.

[73] Assignee: Crown Cork & Seal Technologies Corporation, Alsip, Ill.

[21] Appl. No.: 09/241,481

[22] Filed: Feb. 1, 1999

[51] Int. Cl.[7] ..... B21D 41/04

[52] U.S. Cl. ..... 72/352; 72/370.02; 413/69

[58] Field of Search ..... 72/39, 352, 354.6, 72/354.8, 356, 370.02, 463; 413/69

[56] References Cited

U.S. PATENT DOCUMENTS

| | | | |
|---|---|---|---|
| 3,468,153 | 9/1969 | Patarini et al. | 72/370.02 |
| 3,581,542 | 6/1971 | Wahler et al. | 72/354.6 |
| 3,586,175 | 6/1971 | Gauld | 214/1 |
| 3,812,696 | 5/1974 | Kneusel et al. | 72/352 |
| 3,869,893 | 3/1975 | Plaister et al. | 72/39 |
| 3,983,729 | 10/1976 | Traczyk et al. | 72/43 |
| 4,003,324 | 1/1977 | Tate et al. | 113/7 R |
| 4,272,977 | 6/1981 | Gombas | 72/121 |
| 4,362,254 | 12/1982 | Roth et al. | 220/307 |
| 4,442,693 | 4/1984 | Walter et al. | 72/354 |
| 4,513,595 | 4/1985 | Cvacho | 413/69 |
| 4,519,232 | 5/1985 | Traczyk et al. | 72/133 |
| 4,557,167 | 12/1985 | Cvacho | 82/47 |
| 4,760,725 | 8/1988 | Halasz | 72/84 |
| 4,774,839 | 10/1988 | Caleffi et al. | 72/354 |
| 5,148,742 | 9/1992 | Stirbis et al. | 101/40 |
| 5,231,926 | 8/1993 | Williams et al. | 101/40 |
| 5,282,375 | 2/1994 | Lee, Jr. et al. | 72/4 |
| 5,349,837 | 9/1994 | Halasz et al. | 72/94 |
| 5,355,710 | 10/1994 | Diekhoff | 72/379.4 |
| 5,433,098 | 7/1995 | Bowlin et al. | 72/117 |
| 5,467,628 | 11/1995 | Bowlin et al. | 72/126 |
| 5,497,900 | 3/1996 | Caleffi et al. | 220/656 |
| 5,724,848 | 3/1998 | Aschberger | 72/356 |
| 5,813,267 | 9/1998 | Aschberger et al. | 72/125 |

FOREIGN PATENT DOCUMENTS 0 570 005 A2 11/1993 European Pat. Off. .

*Primary Examiner*—Lowell A. Larson
*Attorney, Agent, or Firm*—Woodcock Washburn Kurtz Mackiewicz & Norris LLP

[57] ABSTRACT

A container necking tool, and corresponding method, for necking an aluminum beverage can is disclosed that includes a punch sleeve that is longitudinally fixed in relation to a necking die. The sleeve and die form a gap therebetween, into which a pusher assembly pushes the container to produce the neck on a necking contour surface. The necking tool also includes a punch body that has a longitudinal air passage therethrough. A plenum is formed between the punch body and sleeve to angularly distribute compressed air around the sleeve. Compressed air pressurizes the container during necking stage, and is diverted to the gap while the can is disengaged from the necking tool to keep the gap clean of debris.

17 Claims, 8 Drawing Sheets

APPARATUS AND METHOD FOR NECKING CONTAINER ENDS

FIELD OF THE INVENTION

The present invention relates to machinery and methods for metal manufacturing, and more particularly to machinery and methods for manufacturing aluminum beverage containers, and even more particularly to necking an open end of aluminum beverage containers.

BACKGROUND OF THE INVENTION

The beverage container manufacturing industry has, for many years, sought to reduce the weight and amount of metal used in two piece beverage cans. A manifestation of this trend is cans having tapered necks. There are two basic techniques used to transform a roughly cylindrical drawn and ironed can body into a semi-finished container with a tapered neck: spin necking and die necking. Spin necking involves rotating the cylindrical container about its centerline axis and applying pressure to the open end to reduce its diameter. Die necking involves moving the open end of the can over a series of progressive dies that gradually reduce its diameter while providing a tapered smooth surface.

A conventional die necking operation utilizes a stationary, circular die that surrounds a longitudinally translatable center ring (also referred to as a punch or a support ring). At the beginning of each necking stage, an exposed, accessible lower end of the center ring is stationary in an initially extended position relative to the stationary die until a pusher mechanism pushes a can (open end first) toward the die and over the center ring. After the can engages the center ring, the center ring and can retract within the die, which remains stationary, to form a neck shape of the can. The can and center ring reverse direction, and the can is disengaged from the die and center ring to constitute one stage of the necking operation. Conventional necking operations employ several necking stages.

For examples of die necking, U.S. Pat. No. 3,983,729 (Traczyk) discloses a die necking apparatus that also creates a flange on the end of the container that is used to attach the closure to the body. U.S. Pat. No. 4,774,839 (Caleffi et al.) generally describes a die necking operation wherein a series of turrets are used to transfer the container to each stage. Each turret has a die having a slightly different diameter and degree of taper so that the end diameter and shape of the neck are progressively reduced. Many considerations that go into the determination of the die shapes for each stage are well known, such as those illustrated in U.S. Pat. No. 5,355,710 (Diekhoff). Each of the three patents listed above are incorporated herein by reference in their entireties.

The necking tooling, specifically the center ring, may be driven upward either by a constant motion cam or a differential motion cam. A constant motion cam retracts (that is, moves upward within the die), the center ring at a rate that matches the rate at which the container moves (both relative to the stationary die) such that, after the container engages the center ring, there is no differential longitudinal movement between the center ring and the can. A differential motion cam retracts the center ring at a greater rate than that of the container such that the friction force between the center ring and the container helps to draw the can into the die. Therefore, a differential motion cam requires less force to be transmitted by the pusher. However, for both the constant motion and differential motion cams, the wear associated with the moving parts in the ram requires maintenance and equipment down-time at regular intervals.

The center ring floats with respect to the stationary die (in conventional motion tooling) because of clearance between the upper ram and its supports. A small amount of float in some circumstances may be beneficial to enable the tooling to accept cans that are slightly misaligned with respect to the center ring and to accommodate container ovality or variations in container wall thickness, which can be a result of the wall ironing process or prior necking stage. However, in either constant motion or differential motion cams, the float between the center ring and the die typically may be up to 0.012 (twelve thousandths) inch (0.305 mm) maximum amplitude in part because the clearances between the ram and its supports. Such a large degree of float, which increases with the wear of the ram and its sliding support, may allow the center ring to pinch the container against the die and may cause disuniform thickness of the neck. Further, the motion of the center ring may cause it to contact the die and may transfer lubricant to the inside of the can, which has obvious detrimental consequences.

SUMMARY OF THE PRESENT INVENTION

It is a goal of the present invention to provide an apparatus and method for necking an open end of a beverage container that enhances the reliability and reduces the maintenance associated with the necking operation by minimizing wear, while diminishing the negative effects of center ring float. It is a further goal to improve the effectiveness of the necking operation.

A container necking tool is provided that includes a necking die having a necking contour surface formed on an inside surface thereof for radially necking an open end of a container; a punch sleeve disposed inside of the necking die and longitudinally fixed relative to the necking die; and a container pusher spaced apart from the necking contour surface. The pusher has a container support platform that pushes an open end of a container into the necking die to radially inwardly neck the container.

The necking die (especially the first stage) may also have a slope surface disposed on a lower portion of the necking die for aligning the container as the container is pushed into the necking die. The punch sleeve and necking die form a substantially annular gap therebetween for receiving a sidewall on the container therein. Preferably, a punch body is removably coupled to the punch sleeve. The punch body has an outer diameter that is referenced to an inside surface of the necking die. Because the punch sleeve may be concentrically coupled to the punch body, the punch sleeve may be accurately and repeatably aligned with the die.

The punch body forms a longitudinal bore therethrough that forms a compressed air passage to channel compressed air from a main compressed air passage to a plenum disposed in the necking tool. The compressed air pressurizes the container during the necking operation to stiffen the sidewall during necking and to disengage the container from the center ring after necking. The punch sleeve extends past a narrow portion of the gap formed between the sleeve and necking die such that the container disengages from the die before it disengages from the sleeve. During this period, as well as during the actual necking, the compressed air is diverted through the gap formed between the sleeve and the die to keep the gap clean of debris, which may prevent defects in subsequent cans.

A method is also provided that includes the steps of positioning a container relative to a first necking die and a first punch sleeve; producing relative longitudinal movement of the container toward the first necking die to engage the external surface of a portion of the open end of the container with the first necking die at an angle to deform the sidewall radially inward; maintaining a fixed position of the first necking die relative to the first punch sleeve during the relative movement of the container toward the first necking die; and producing relative longitudinal movement of the container away from the first necking die to disengage the container from the first necking die. The method may include the step of pressurizing an interior chamber of the container. Further, the container may disengage from the die before disengaging from the sleeve, which encourages compressed air to flow through the gap formed between the sleeve and the die to keep the gap clean of debris.

DETAILED DESCRIPTION OF A PREFERRED EMBODIMENT

Figure 1:
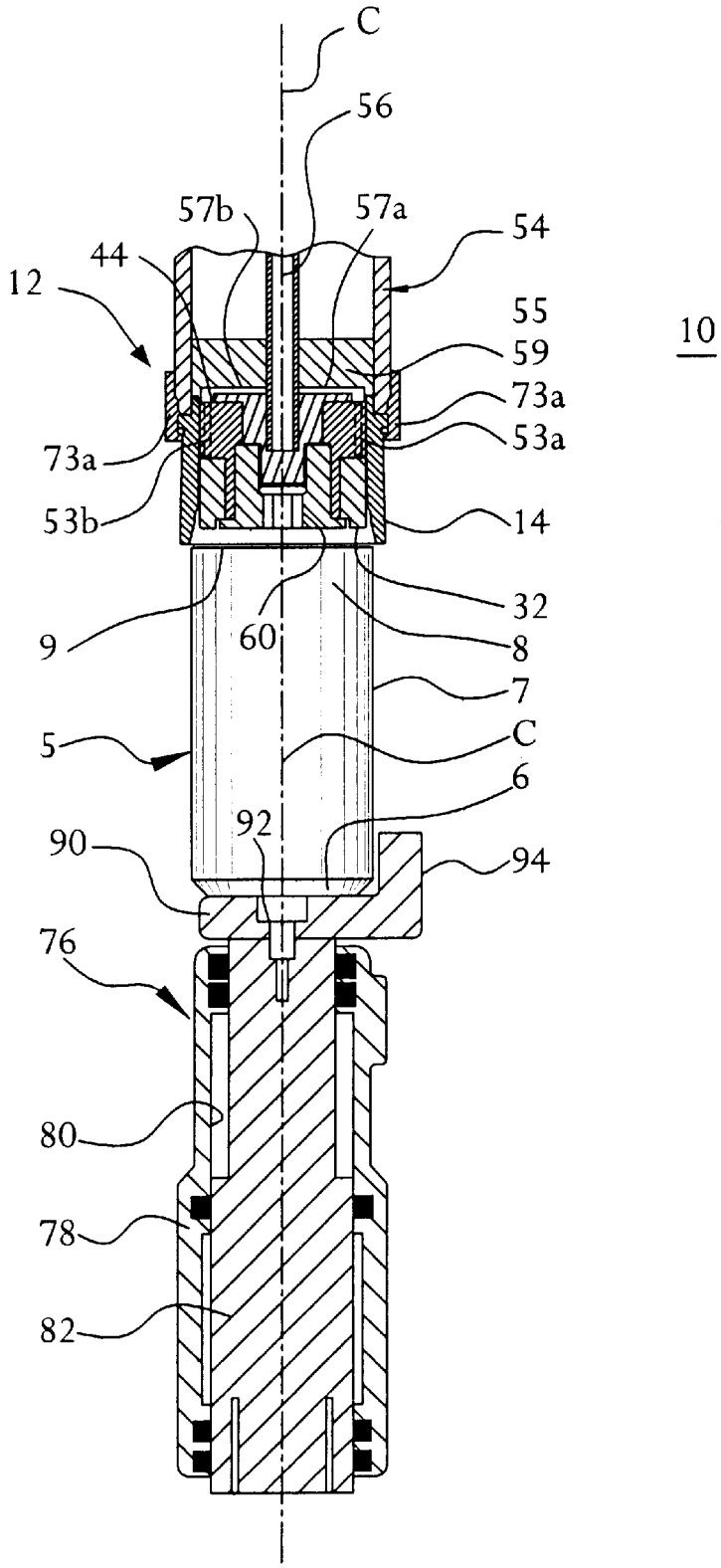
FIG. 1 is a cross sectional view of an embodiment of the present invention.
Figure 2:
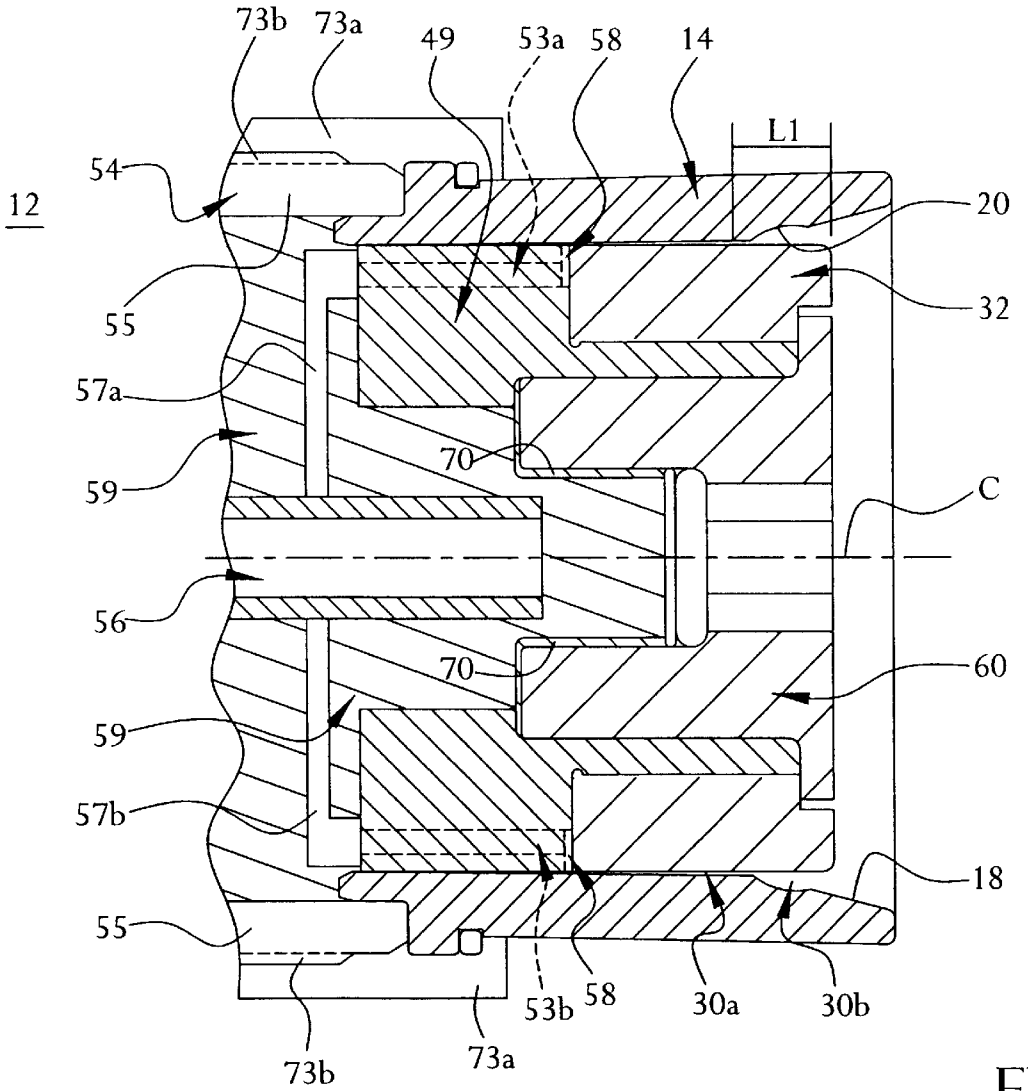
FIG. 2 is an enlarged view of a portion of the embodiment shown in FIG. 1.

Referring to FIGS. 1 and 2, which show the assembled components to illustrate an embodiment of the present invention, a necking tool 10 includes a pusher subassembly 76 and an opposing upper forming or necking assembly 12. Necking assembly 12 includes a die 14, a punch sleeve 32, a punch body 44, an upper frame 54, and a retaining bolt 60. The components define a longitudinal centerline C. A can or container 5, which is the work piece for necking tool 10, is disposed between pusher assembly 76 and necking assembly 12. Container 5 includes a base 6, a sidewall 7, and a lip 9 formed at the end of an open end 8, which is opposite the base 6. Container 5 is in the stage of manufacturing before a lid is fixed thereto.

The discussion will provide dimensional information of the components, especially the dimensions and tolerances relating to the components that enable accurate positioning of punch sleeve 32 relative to die 14, to illustrate a particular embodiment of the present invention. These dimensions are for illustrative purposes, and the present invention is not limited to the particular embodiments having the dimensions disclosed herein. Further, the dimensions provided herein are for a die that is employed as the first stage of a multi-stage necking process, as will be clear to persons familiar with such necking processes.

Figure 3:
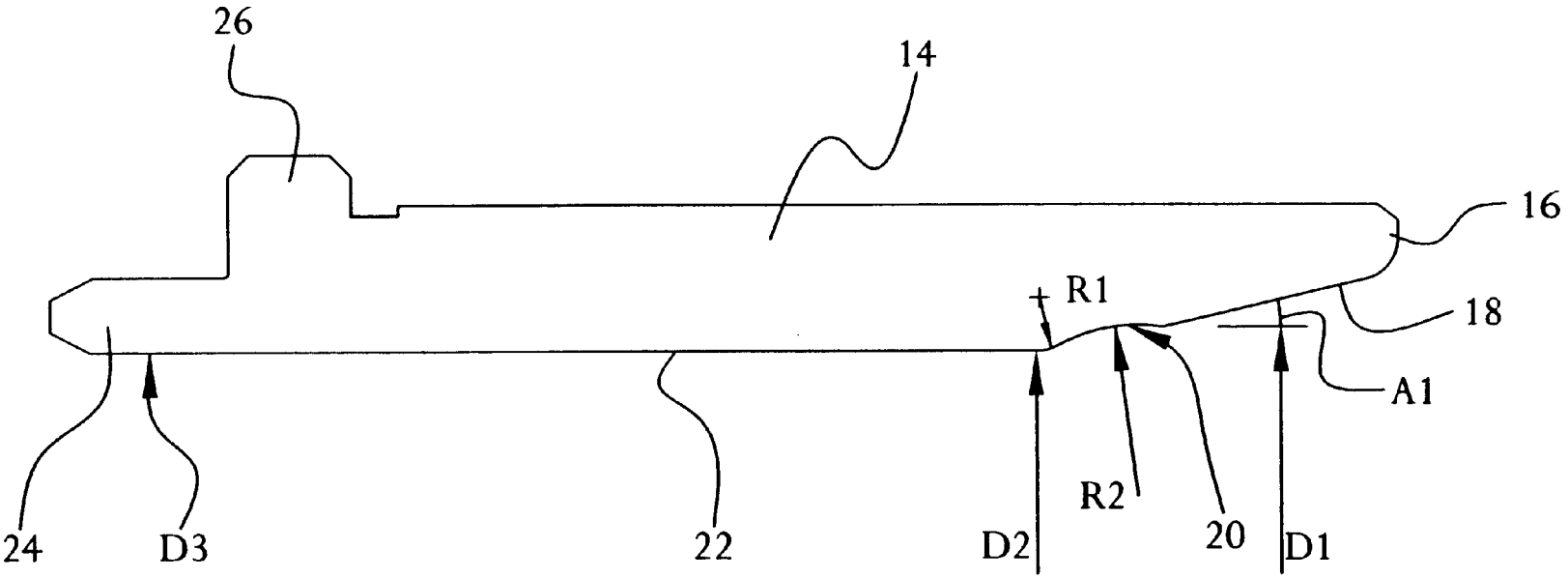
FIG. 3 is an enlarged cross sectional view of a portion of the necking die shown in FIG. 1.

FIG. 3 shows a cross sectional profile of the necking die 14. Referring to FIGS. 1, 2, and 3, necking die 14 includes a die nose 16 disposed on its lower tip that yields to a slope portion 18 on its inside surface. Slope surface 18 preferably forms an angle A1 with the longitudinal axis (which is parallel to centerline C shown in FIG. 1) of approximately 15°. As best shown in FIG. 3, slope portion 18 smoothly yields to a necking contour surface 20 that has two opposite arcuate segments that define radii of curvature R1 and R2, the values of which are determined to provide a desired necking configuration as will be understood by persons familiar with necking operations.

Referring particularly to FIG. 3, an inside diameter D1 of die 14 at the lower end of the contour surface 20 near radius R2 preferably is approximately 2.6075" (6.623 cm). This value of diameter D1 is exemplary, and may be based on the outer diameter of the container to be necked. Contour surface 20 preferably smoothly yields to interior surface 22, which defines an inner diameter D2 at the upper end of radius R2. Interior surface 22 preferably has two concentric bores: a diameter D2 in the necking region that is 2.530" +/−0.001" (6.426 cm+/−0.0254 mm) and a diameter D3 at the non-working (upper) end that is 2.534" +0.001/−0.000" (6.436 cm +/−0.0254 mm). The portion surface 22 that has bore D2 is approximately 0.1" (2.54 mm) long. An undercut portion 24 is at the back or upper end of die 14. An outer flange 26 rises from undercut 24. Outer flange 26 has chamfers on each side. Die 14 is preferably formed of a single piece of abrasion-resistant steel, such as hardened steel.

Slope portion 18 of die 14 may help guide container 5 during the necking process (that is, during the up-stroke of the pusher), which is especially beneficial for a can top that is out-of-round or that has a varying wall thickness about its circumference. Therefore, the configuration described with respect slope portion 18 to FIG. 3 is best suited to the first necking stage of a multi-stage necking operation. Subsequent necking stages may not require such a slope portion.

Figure 4:
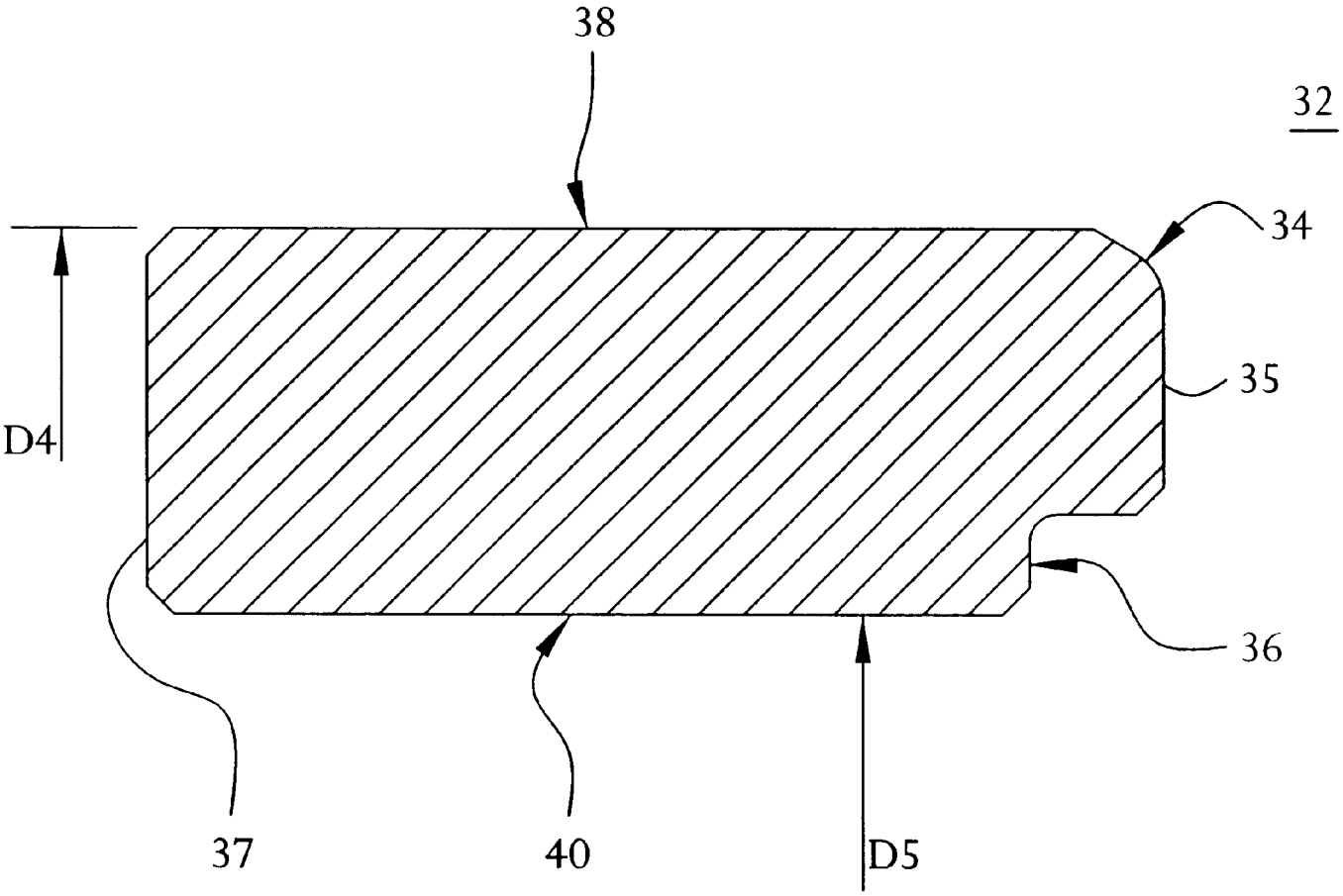
FIG. 4 is an enlarged cross sectional view of a portion of a punch sleeve that is shown in FIG. 1.

FIG. 4 shows a cross sectional profile of the punch sleeve 32. Referring to FIGS. 1, 2, and 4, punch sleeve 32 forms an annulus having a punch nose 34 and an undercut groove 36 formed on the lower, inside surface of punch sleeve 32. A flat front face 35 is formed between punch nose 34 and groove 36. A flat rear surface 37 is opposite front face 35.

Sleeve 32 forms a substantially cylindrical outer surface 38 and an inner surface 40, which define diameters D4 and D5, respectively. Values for diameters D4 and D5 are discussed below. Surfaces 38 and 40 form a 45 degree chamfer with the top surface 37. Also, a 45 degree chamfer is formed where groove 36 meets front face 35 and inner surface 40. Nose 34 forms a straight, preferably 30 degree slope (from the center axis C) on its outer portion that yields to an arcuate portion to smoothly transition into the flat front or bottom face of die 14. Sleeve 32 is preferably formed of an abrasion resistant material, such as carbide.

Referring to FIGS. 1, 2, 5A, and 5B, punch body 44 has an annular base 52 from which an annular member 46 projects. A retaining bolt bore 50 longitudinally extends through punch body 44. Bore 50 changes its diameter to form a shoulder 51 in the interior of body 44. The forward or lower tip of member 46 forms a punch body nose 48. Annular member 46 has an outer surface 49 that defines an annular member outer diameter D6. Illustrative values for diameter D6 are provided below.

Member outer surface 49, together with base 52, forms a cut-out portion 47*a* in which sleeve 32 is disposed, as best shown in FIGS. 1 and 2 and described below. A second cut-out portion 47*b* is formed in base 52 along the outer periphery of cutout 47*a*. Cut-out portion 47*b* preferably is a circular groove that forms a plenum 58 (described below) with rear surface 37 of sleeve 32. Two longitudinal passages 53*a* and 53*b* are formed through the base portion 52 with an end opening at the cut-out portion 47*b*.

An outer surface 45 of base 52 is preferably cylindrical and defines an outer-most diameter D7 of punch body 44. Illustrative values for diameter D7 are provided below, although outer diameter D7 preferably is slightly larger than the outer diameter D4 of sleeve 32.

Referring to FIGS. 1, 2, 6A, and 6B, retaining bolt 60 includes a substantially cylindrical body 66 having an outer flange 63 at its lower end. An upper side of flange 63 forms a contact surface 64. Bolt 60 has a bore 68 centrally formed therein that has a cylindrical upper portion with threads 70 disposed therein. Bore 68 forms an internal hexagonal head 65 at the front or lower end of retaining bolt 60. A flat base surface 72 is formed opposite hexagonal head 65.

Referring to FIGS. 1 and 2, upper frame 54 includes a main longitudinal sidewall 55 and a main compressed air passage 56, which is preferably formed by a pipe. A pair of bleed air passages 57*a* and 57*b* are formed in a frame end member 59 substantially perpendicular to main compressed air passage 56. Passages 57*a* and 57*b* each have one end in communication with main compressed air passage 56 and another end proximate bores 53*a* and 53*b*, respectively, in punch body 44.

Referring particularly to FIGS. 1 and 2 to illustrate the assembled configuration of the components of necking assembly 12, sleeve 32 is disposed in cut-out 47*a* (shown in FIG. 5B) in punch body 44 such that sleeve 32 is referenced from die 14 according to an aspect of the present invention. The terms "reference from," and other forms of the terms, refer in the specification and claims the accurate and precise relative positioning of a first member relative to other members. Specifically, the terms refer to an accurately and precisely formed surface on a first member that contacts or corresponds to an accurately and precisely formed surface on a second member for the purpose of accurately and precisely positioning the members. Further, the terms may broadly encompass a third member that has two accurately and precisely formed surfaces: one contacting or corresponding to the first surface and the other contacting or corresponding to the second surface. Therefore, sleeve 32 is referenced from die 14 because inner diameter D5 of sleeve 32 is matched (that is, has a similar value considering clearance and manufacturing tolerance) to outer diameter D6 of surface 49 of body 44, and outer diameter D7 of surface 45 of body 44 is matched to diameter D3 of surface 22 of die 14. Thus, by the broad use of the term, sleeve 32 is referenced from die 14.

Using the components shown in the FIGS. 3, 4, 5*a*, and 5*b* to illustrate a set of dimensions, and referring also to FIG. 2, the diameter D5 of the inner surface 40 of sleeve 32 is 1.744" +0.000/−0.001" (4.430 cm +0/−0.0254 mm) and the diameter D6 of an outer surface 49 of annular portion 46 is preferably 1.741" +0.001/−0.000 (4.422 cm +0.0254/−0 mm). Thus, a nominal diametral clearance of 0.003"(0.0762 mm) is formed therebetween.

Regarding the positioning of body 44 with respect to die 14, the outermost diameter of body 44 is matched to the inside surface of die 14. Again using the components of the figures to illustrate a set of dimensions, the diameter D7 of the outer surface 45 of punch body 44 is 2.533" +0.0000/−0.0005" (five ten-thousandths) (6.434 cm +0/−0.0127 mm). Interior surface diameter D3 of die 14 is 2.534" +0.001/−0.000" (6.436 cm +/−0.0254 mm). Thus, a slight nominal diametral clearance of approximately 0.001" (one thousandth) (0.0254 mm) is formed between the outermost surface of base 52 and surface 22 of die 14. The clearances discussed herein do not take differential thermal expansion into account.

The close relationship between die inner surface 22, body 44, and sleeve 32 ensures accurate positioning of sleeve 32 relative to the die inner surface. Specifically, the slight clearance between diameters D5 and D6 ensures that sleeve 32 is accurately positioned with respect to body 44. The slight clearance between diameters D3 and D7 ensures that body 44, and therefore sleeve 32, is accurately positioned with respect to die 14. Further, the tight tolerances of the diameters enhance the precise and uniform positioning of sleeve 32 with respect to die 14, and enhance interchangeability among parts (for example, replacing worn sleeves or changing sleeves among necking stages).

Figure 8:
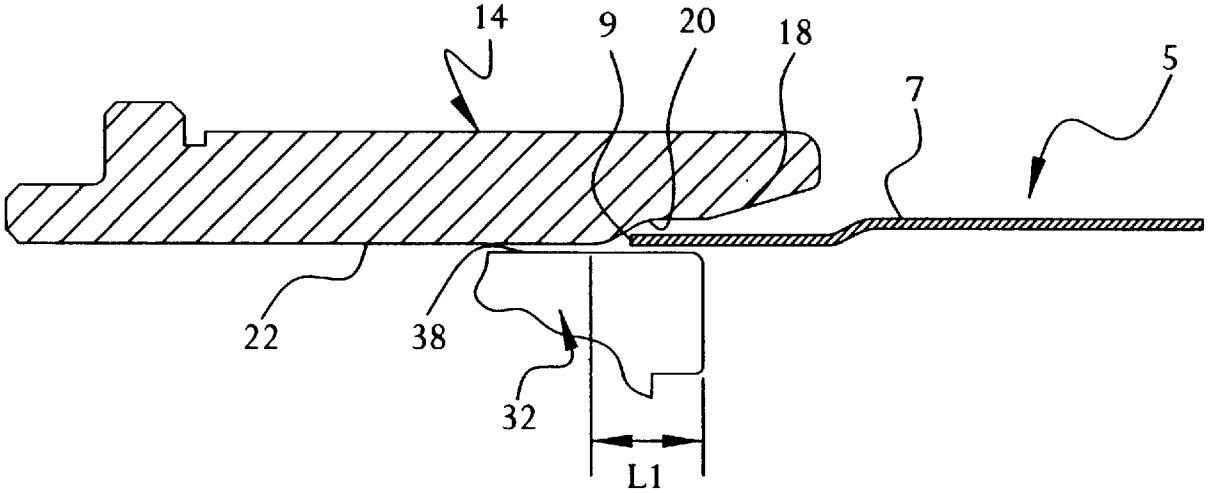
FIG. 8 is a schematic view of a die and a portion of a punch sleeve according to the present invention showing the container in a necking stage.

Because sleeve 32 is referenced from die 14 (and therefore concentrically disposed), a gap 30*a*, formed between sleeve 32 and die 14, has a uniform width throughout its circumference, as shown in FIG. 2. Specifically, the diameter D4 of the outer surface of sleeve 32 is 2.516" +/−0.0001 (one ten-thousandth) (6.391 cm +/−0.0025 mm). Thus, outer surface 38 of sleeve 32 and surface 22 of die 14 form a diametral clearance of approximately 0.0140" +/−0.0002" (0.356 mm +/−0.0051 mm) by comparing D4 with D2 (2.530"). Therefore, the width of gap 30*a* is 0.007" (0.178 mm) at interior surface 22 proximate contour surface 20. Further, a gap 30*b*, which is formed between sleeve outer surface 38 and necking contour surface 20 (that is, below gap 30*a*), is much wider than gap 30*a* because of the relief bore of surface 20. Referring to FIGS. 2 and 8, sleeve 32 preferably extends below the upper end of contour surface 20 to form a gap 30*b* that is approximately 0.25" (6.35 mm), as shown by length L1.

Figure 5A:
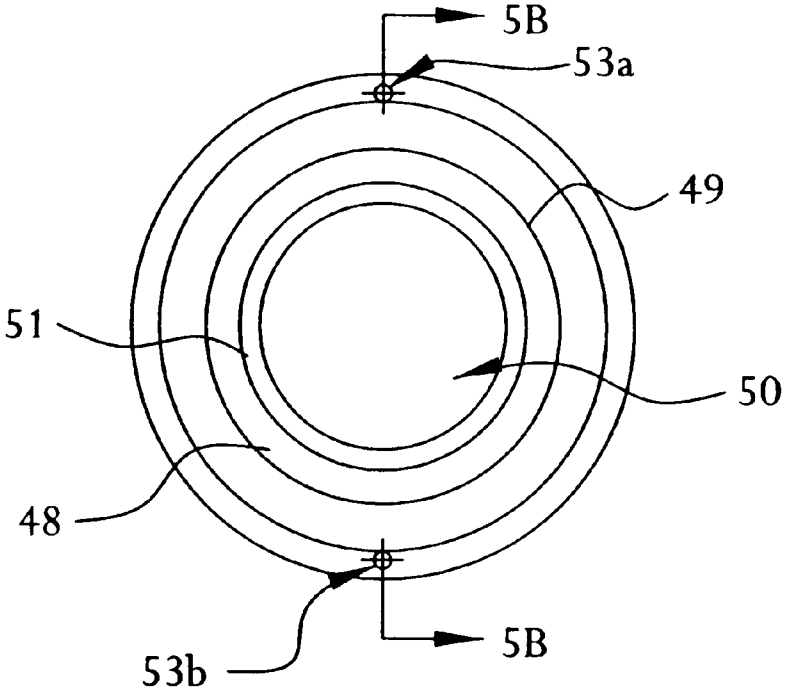
FIG. 5A is an enlarged end view of a punch body that is shown in FIG. 1.
Figure 5B:
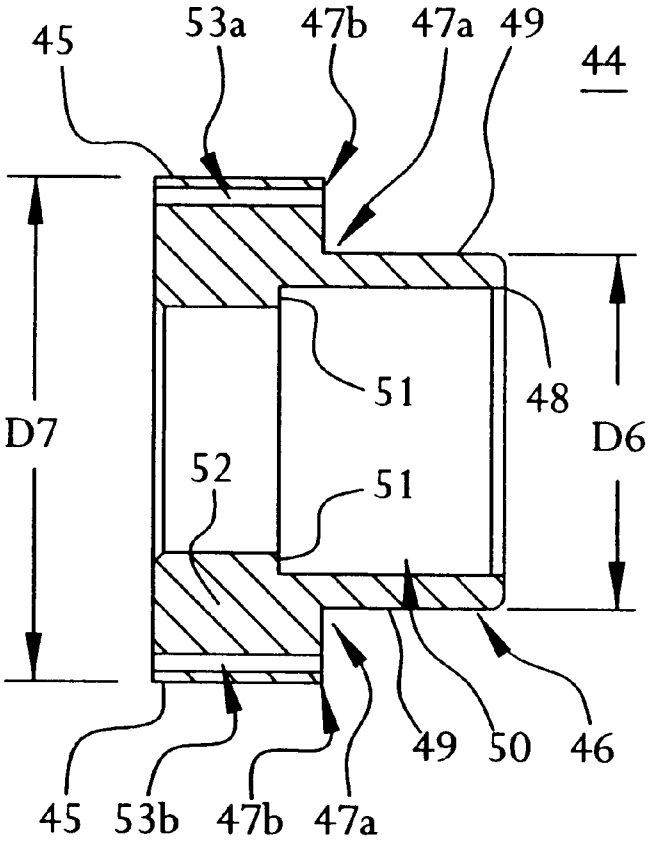
FIG. 5B is a cross sectional view taken along line 5B—5B in FIG. 5A;.
Figure 6A:
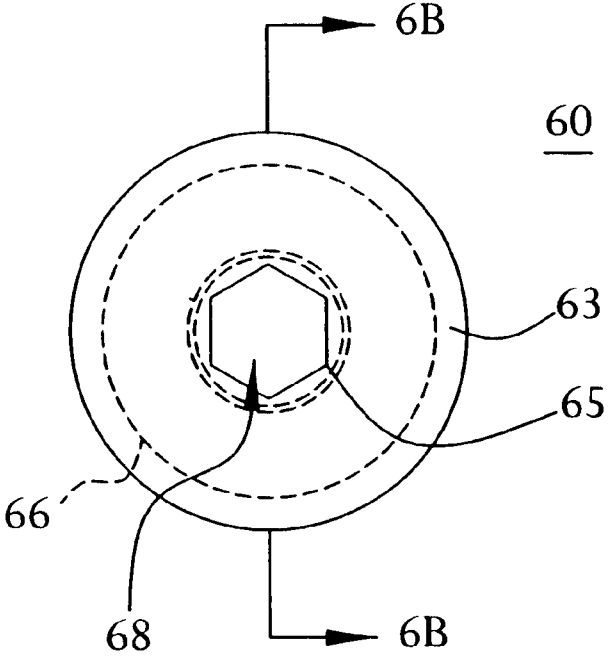
FIG. 6A is an enlarged end view of a retaining bolt that is shown in FIG. 1.
Figure 6B:
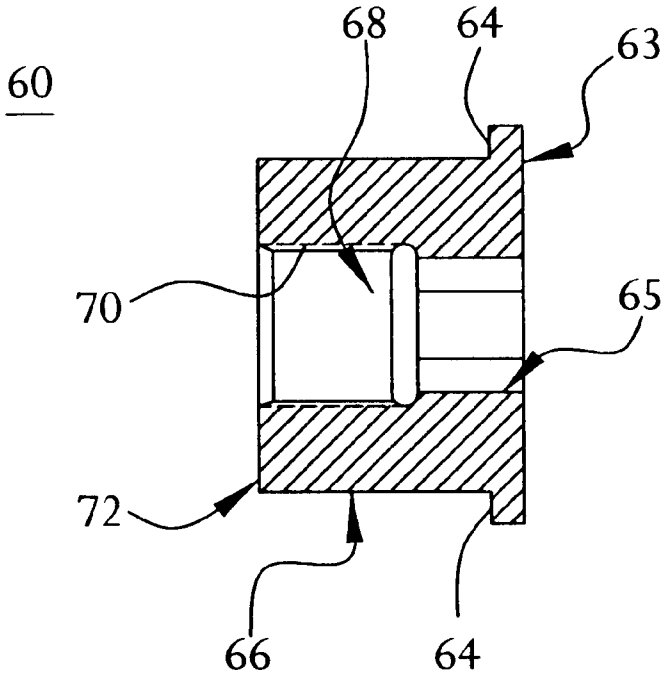
FIG. 6B is a cross sectional view taken along line 6B—6B in FIG. 6A.

Plenum 58, as best shown in FIG. 2, according to another aspect of the present invention, is formed by sleeve rear surface 37 (FIG. 4) and cut-out 47*b* (FIG. 5B). Body bores 53*a* and 53*b* communicate with plenum 58, which is continuous around the circumference of cut out 47*b* to enable distribution of compressed air circumferentially around plenum 58.

Again referring to FIG. 2, cylindrical body 66 of retaining bolt 60 (FIG. 6B) is disposed within punch body 44 such that the outer surface of body 66 and bore 50 form a diametral clearance of approximately 0.020" (0.51 mm). An upper outer edge of base surface 72 of bolt 60 may contact shoulder 51 in the inside of punch body 44. Contact surface 64 on the upper side of bolt flange 63 may contact sleeve 32 in groove 36 of punch sleeve 32 (FIG. 4), and may contact nose 48 of punch member 44 (FIG. 5B), such that upper surface 37 contacts the wall portion of cutout 47*a*. Threads 70 on the inside of bolt 60 are threaded into matching threads disposed on frame end member 59. A hexagonal tool, such as an Allen key, may be employed for use in hexagonal head 65 to fasten bolt 60 to frame end member 59. Because retaining bolt 60 may be screwed into frame end member 59, bolt 60, and particularly flange 63, retains punch sleeve 32 and punch body 44 by securing them against frame 54. Die 14 may be fixed to frame 54 by a screw cap 73*a* having screw threads 73*b*, or by any other suitable means. Screw cap 73 preferably clamps against flange 26 to affix die 14.

Again referring to FIGS. 1 and 2, main compressed air passage 56 is in fluid communication with the interior of container 5 via interior bore 66 of retaining bolt 60. Bleed air passages 57*a* and 57*b*, which are formed in frame end member 59, are in fluid communication with passage 56, and enable communication between passage 56 and longitudinal bores 53*a* and 53*b* in punch body 44. Bores 53*a* and 53*b* communicate with plenum 58, which communicates with gaps 30*a* and 30*b*.

Referring to FIG. 1 the pusher assembly 76 includes an outer cylindrical member or sleeve 78 that has a generally circular opening 80 with a ram or piston 82 reciprocally movable in the opening 80. The lower end of ram 82 has a cam follower (not shown) that is actuated by a cam (not shown) to move ram 82 up and down. The upper end of ram 82 has a container support platform 90 secured thereto by a recessed fastener 92. Support platform 90 preferably has an arcuate extension 94 that engages the lower portion of the container 5.

Operation

Figure 7:
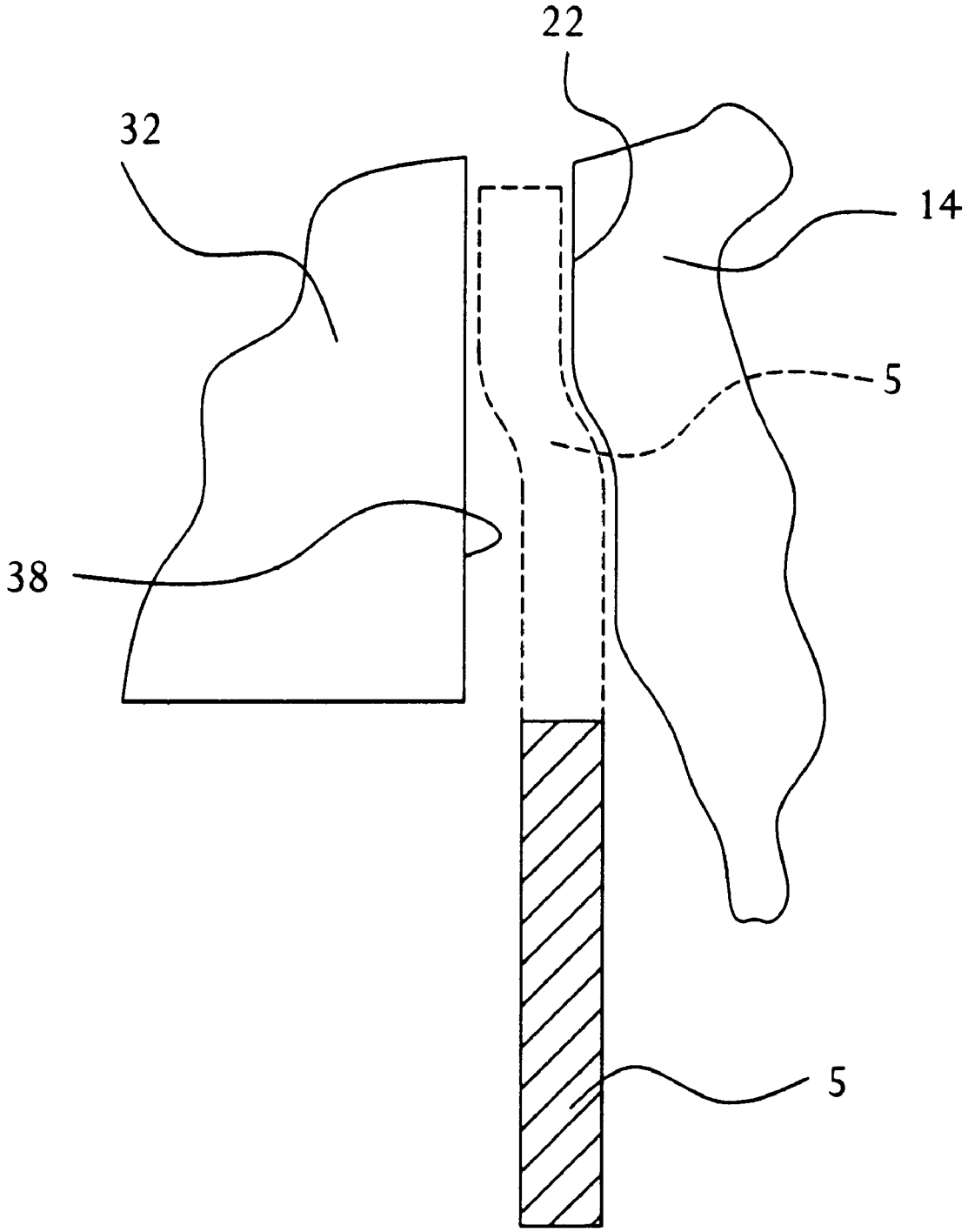
FIG. 7 is an enlarged schematic view of a portion of the tooling according to the present invention.
Figure 9:
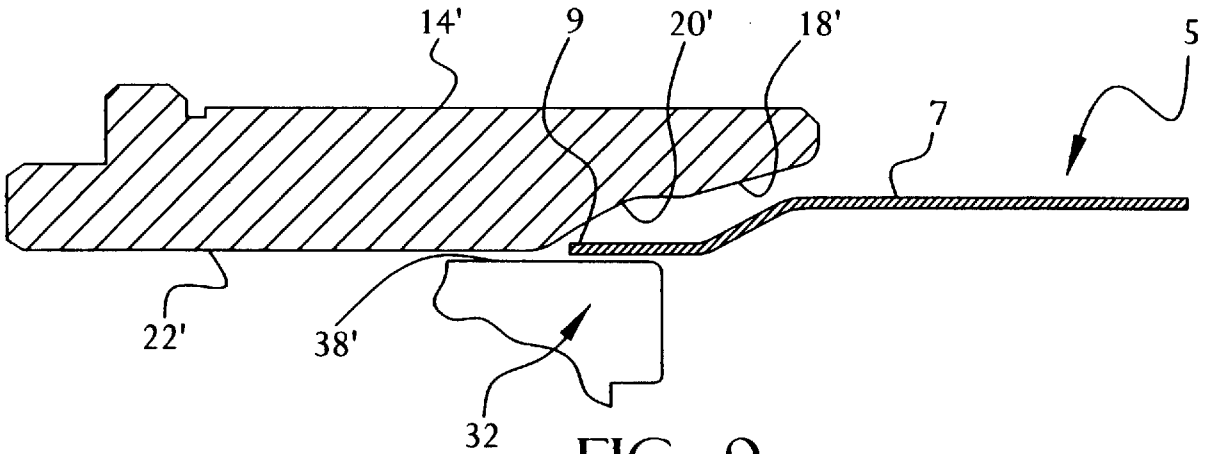
FIG. 9 is a schematic view of another die and another portion of a punch sleeve according to the present invention showing the container in a necking stage subsequent to the stage shown in FIG. 8.

FIGS. 1, 2, and 7–9 illustrate the operation of the necking tool 10, and also illustrate the method according to the present invention. FIG. 7 shows container 5 before the necking stage, and shows the necked product in phantom. FIGS. 8 and 9 show sidewall 7 engaged with sleeve 32 after the necking at the particular stage. The reference numerals of FIG. 9 (specifically 14', 18', 20', 22', and 38') are shown with a' (prime) designation to illustrate that they represent a subsequent necking stage from that shown in FIG. 8. Thus, the present invention encompasses multiple necking stages. For clarity, the subsequent discussion refers only to reference numerals without the prime designation, although it applies equally to the components of FIG. 8 and FIG. 9.

Container 5 is positioned on container support platform 90, and therefore is roughly concentrically aligned with centerline C. Container 5 is moved upward toward necking assembly 12 by pusher assembly 76, as will be understood by persons familiar with conventional container necking processes. The upper lip 9 of sidewall 5 may contact slope 18 to move container 5 into radial alignment with die 14 if container 5 is not properly aligned with centerline C. Pusher assembly 76 further moves container 5 toward die 14 until the outer portion of sidewall 7 comes into contact with necking contour surface 20 and engages sleeve 32. After container 5 engages sleeve 32, a compressed air source (not shown) may be turned on. Compressed air flowing through main compressed air passage 56 pressurizes the interior of container 5. Compressed air also flows through bleed air passages 57*a* and 57*b* and bores 53 and 53*b* to pressurize plenum 58.

The pressurization of plenum 58 prevents back-flow leakage from container 5 past sleeve 32. Further, the pressurization of container 5 reinforces and stiffens sidewall 7 while the necking process occurs to enhance the strength of the sidewall. Therefore, the pressurization of the interior of container 5 helps prevent puckering or sculpting of the neck during the necking stage.

Pusher assembly 76 continues to move container 5 upward such that lip 9 moves past contour surface 20, which imparts a first bend onto sidewall 7, and surface 38 of sleeve 32, which imparts a second, opposite bend onto sidewall 7, as shown in phantom in FIG. 7. At a predetermined longitudinal location, pusher assembly 76 retracts downward or away from necking assembly 12. The air pressure inside container 5 pushes container base 6 against container support platform 90 such that container 5 moves downward with platform 90.

As best shown in FIGS. 2, 8, and 9, as pusher assembly 76 retracts away from necking assembly 12, sidewall 7 disengages from die 14 before it disengages from sleeve 32. Specifically, as container 5 moves away from necking assembly 12, lip 9 of container 5 moves longitudinally past the lower end of interior surface 22 to disengage sidewall 7 from die 14. At this point, which is the approximate position shown in FIGS. 8 and 9, sidewall 7 is still disposed around (that is, engaged with) sleeve 32. As described above, sleeve 32 may extend below the lower end of surface 22 such that container 5 may be engaged with only sleeve 32 (and not die 14) for approximately 0.25" (0.64 cm) (that is, L1).

According to another aspect of the present invention, during the period in the retraction phase in which container 5 is engaged with sleeve 32 and disengaged from die 14, the close relationship between container 5 and surface 38 of sleeve 32 (FIGS. 8 and 9) inhibits compressed air from flowing out of container 5. However, during this period, the passage from plenum 58 through gap 30*a* is no longer impeded by sidewall 7. Therefore, compressed air flows from main compressed air passage 56, through bleed air passages 57*a* and 57*b*, and through longitudinal passages 53*a* and 53*b*. The compressed air is distributed angularly through plenum 58, and flows through gaps 30*a* and 30*b*. Such air flow keeps gaps 30*a* and 30*b* clean of debris.

A temporary sharp increase in air pressure may be employed to augment the disengaging of container 5 from necking assembly 12. Further, a movable knockout member (not shown) may be used to extend through bolt bore 68 and push against the inside surface of base 6 to disengage or augment disengagement of container 5 from die 14 and sleeve 32, as will be understood by persons familiar with necking processes and machinery. After container 5 disengages from sleeve 32, the compressed air flow may be shut off or reduced.

The dimensions and tolerances for subsequent stages of the necking process may vary from the exemplary dimensions and tolerances provided about with respect to a first necking stage. Particularly, the dimensions and tolerances relating to the gap 30*a* may vary as the can wall becomes thicker with each progressive necking stage.

Advantages

Positioning the sleeve in a longitudinally fixed relation to the necking die provides several advantages. Because the sleeve is longitudinally fixed relative to the necking die, the manufacturing and assembly tolerances of the components may be reduced to provide greater uniformity and accuracy in the necking stages. Particularly, referencing the punch sleeve off the die (via the punch body) enables tight tolerance of the components and the assembly, which enables the gap between the punch sleeve and the necking die to be uniform and accurately controlled.

The necking load transmitted from a pusher in conventional, moveable necking tooling through a container is typically 100 to 150 pounds, depending on the container type, wall thickness, necking stage, and like parameters. Eliminating sliding parts may increase the required necking load by 35 to 40 pounds for an aluminum can of approximately 0.006" (0.15 mm) wall thickness at the first necking stage, compared with a differential motion cam load. Experimental results show that such a container can withstand such an increase in necking load.

Eliminating the sliding parts (that is, the parts associated with moving the center ring, as explained in Caleffi, for example) diminishes wear and reduces maintenance and equipment downtime. Eliminating the large amount of float inherent in the translating center ring enhances uniformity of the necked containers, and reduces defects caused by the friction force (in the differential motion circumstances), which may exacerbate minor imperfections in the container sidewall.

What is claimed is:

1. A method of necking an open end of a container sidewall to form a neck profile comprising the steps of:

a) positioning a container relative to a first necking die and a first punch sleeve;

b) producing relative longitudinal movement of the container toward the first necking die to engage the open end of the container sidewall with the first necking die to deform the sidewall radially inward;

c) maintaining a fixed position of the first necking die relative to the first punch sleeve during step b);

d) pressurizing an interior of the container after the container engages the first necking die;

e) producing relative longitudinal movement of the container away from the first necking die to disengage the container from the first necking die such that the container disengages from the first necking die before the container disengages from the punch sleeve; and f) passing compressed air through a substantially annular gap formed between the first punch sleeve and the first necking die while the container is disengaged from the first necking die and engaged with the punch sleeve.

2. The method of necking of claim 1 further comprising the steps of:

e) positioning the container relative to a second necking die and a second punch sleeve;

f) producing relative longitudinal movement of the container toward the second necking die to engage the open end of the container sidewall with the second necking die to further compress the sidewall radially inward;

g) maintaining a fixed longitudinal position of the second necking die relative to the second punch sleeve during the relative movement of the container toward the second necking die; and e) producing relative longitudinal movement of the container away from the second necking die to disengage the container from the second necking die.

3. The method of necking of claim 1 wherein the annular gap between the first necking die and the first punch sleeve has a uniform radial thickness.

4. The method of claim 1 further comprising the step of pressurizing an interior chamber of the container.

5. The method of claim 1 wherein the pressurizing step includes stiffening of the container sidewall while the open end of the container is radially deformed.

6. The method of claim 1 wherein the pressurizing step includes pushing the container longitudinally away from the first necking die during the step of producing relative longitudinal movement of the container away from the first necking die.

7. The method of claim 1 wherein the step of b) producing relative longitudinal movement includes imparting a first bend onto the container sidewall and imparting a second bend onto the container sidewall.

8. The method of claim 7 wherein the first bend and the second bend have opposing directions.

9. A container necking tool comprising:

a necking die having a necking contour surface formed on an inside surface thereof for radially necking an open end of a container;

a punch sleeve disposed inside of the necking die and longitudinally fixed relative to the necking die, the punch sleeve having a reference surface that is referenced from a die reference surface, the punch sleeve having a punch sleeve cylindrical surface, the necking die having a necking die cylindrical surface, the punch sleeve cylindrical surface opposing the necking die cylindrical surface to form a substantially annular gap therebetween for receiving a sidewall of the container therein, the punch sleeve cylindrical surface extending outwardly beyond the necking die cylindrical surface such that the container disengages from the necking die before the container disengages from the punch sleeve;

a compressed air passage being in fluid communication with the annular gap to enable a compressed air to flow therein, and;

a container pusher spaced apart from the necking contour surface, having a container support platform, the pusher imparting relative longitudinal movement between the necking die and the container support platform;

whereby an open end of a container is pushed into the necking die to radially inwardly neck the container and the compressed air flows outwardly through the annular gap while the container is pushed into the necking die.

10. The container necking tool of claim 9 wherein the necking die has a slope surface disposed on a lower portion thereof for aligning the container with the necking die as the container is pushed into the necking die.

11. The container necking tool of claim 9 further comprising a punch body removably coupled to the punch sleeve for supporting the punch sleeve.

12. The container necking tool of claim 11 wherein the punch body has a first reference surface that is referenced from the die reference surface and a second reference surface that is referenced from the punch sleeve reference surface, whereby the punch sleeve is referenced from the die reference surface.

13. The container necking tool of claim 9 further comprising a frame and a fastener coupling the punch sleeve to the frame.

14. The container necking tool of claim 9 further comprising a cap contacting a ring on the necking die for securing the necking die to a frame.

15. The container necking tool of claim 9 whereby the interior of the container is pressurized by the compressed air to push the container against the container support platform.

16. The container necking tool of claim 9 further comprising a punch body removably coupled to the punch sleeve for supporting the punch sleeve.

17. The container necking tool of claim 9 wherein the necking die is formed of a material comprising carbide.

* * * * *

UNITED STATES PATENT AND TRADEMARK OFFICE

CERTIFICATE OF CORRECTION

PATENT NO. : 6,094,961
DATED : August 1, 2000
INVENTOR(S) : Aschberger

It is certified that error appears in the above-identified patent and that said Letters Patent is hereby corrected as shown below:

Column 9, claim 2,
Line 3, delete "e)" and insert -- g) -- therefor.
Line 5, delete "f)" and insert -- h) -- therefor.
Line 10, delete "g)" and insert -- i) -- therefor.
Line 14, delete "e)" and insert -- j) -- therefor.

Column 10, claim 9,
Line 13, delete "of the" and insert -- on the -- therefor.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*